United States Patent [19]

Lohrmann

[11] 3,933,443

[45] Jan. 20, 1976

[54] COKING COMPONENT

[76] Inventor: Hugo Lohrmann, Holzhauerthalstrasse, Neunkirchen-Heinitz, Germany

[22] Filed: Jan. 17, 1974

[21] Appl. No.: 434,225

Related U.S. Application Data

[63] Continuation of Ser. No. 214,450, Dec. 30, 1971, abandoned.

[30] Foreign Application Priority Data

May 18, 1971 Australia ..... 28965/71

[52] U.S. Cl. ..... 44/1 C; 44/1 F; 44/1 G; 44/10 C; 44/15 R; 201/21; 252/182

[51] Int. Cl.[2] .. C10L 5/10; C10B 53/00; C09K 3/00

[58] Field of Search ..... 44/1 C, 1 G, 1 F, 10 C, 44/10 D, 10 F, 10 K, 15 R; 201/21, 22; 252/182

[56] References Cited

UNITED STATES PATENTS

| | | | |
|---|---|---|---|
| 2,732,333 | 1/1956 | Smith | 201/21 X |
| 3,560,346 | 2/1971 | Gunter | 201/22 X |

FOREIGN PATENTS OR APPLICATIONS

| | | | |
|---|---|---|---|
| 1,129 | 1855 | United Kingdom | 44/10 K |
| 81 | 1862 | United Kingdom | 44/10 K |

*Primary Examiner*—Carl F. Dees
*Attorney, Agent, or Firm*—Holman & Stern

[57] ABSTRACT

A coking component consisting essentially of a mixture of 10 to 60 percent of finely ground coke and at least one carbon-containing substance selected from coking coal, non-coking coal, petroleum coke, semi-coke or lignite. The carbon-containing substance has a particle size which is approximately 90 percent below three millimeters. The coking component is easier to transport than coke dust and increases the fixed carbon content of the coking mixture. The coking component is then mixed with coal and the so formed coking mixture is coked.

12 Claims, No Drawings

COKING COMPONENT

BACKGROUND OF THE INVENTION

This is a continuation of application Ser. No. 214,450, filed Dec. 30, 1971, now abandoned.

(1) Field to which the invention relates.

The invention relates to a coking component which is easy to transport and has an increased fixed carbon content.

It is known to add 10–12 % coke dust to coal blends to be coked in order to improve the mechanical strength properties of the coke to be produced, this being a particularly desirable way to reduce the volatiles in the case where coals with more than 25 % volatiles are coked. It makes no difference in the improvement obtained to add coke dust to the same type raw material from which the coke dust was produced.

(2) The prior art

The coke dust added in the prior art to the blends to be coked is ground in the coking plant itself. The coking plants have to be specially equipped to do this. Transportation of the coke dust inside the coking plant onto the blending equipment for preparing the coke oven blend is done pneumatically, in bags or silo cars, which again necessitates special equipment. Finally, storing the coke dust and proportioning it when blending it with the coke oven blend creates further difficulties.

SUMMARY OF THE INVENTION

The instant aim of the invention is to make the use of coke dust in blends to be coked more economical and to reduce or eliminate as much as possible the difficulties in working with coke dust.

According to the instant invention this can be achieved by producing a coking component consisting essentially of a mixture of finely ground coke and a carbon containing substance having a size composition similar to the size composition of fine coal. By carbon containing substance is meant a substance consisting mainly of carbon and capable of being converted into coke in a process of coking. For instance the carbon containing substance can be any type of coal or raw petroleum coke.

The significance of this is:

If one produces the finely ground coke before transportation, this has the double advantage on one hand of a weight reduction both of the amount of volatiles and the humidity of the mixture to be transported, and on the other side of the fact that this commodity contains considerably more fixed carbon per volume unit than regular coal, fixed carbon being the substance which counts in coking. One cubic meter of coke dust contains about 0.62 tons of fixed carbon including ash whereas coal used for coking with a volume weight of, for example, 0.72 tons per cubicmeter and about 22 % volatiles and 10 % moisture, contains only 0.52 tons of fixed carbon including ash per cubic meter.

These advantages of coke dust during handling can however not be easily exploited, since the coke dust generates dust and behaves like a liquid and thus creates considerable difficulties in connection with proportioning, storage, transportation etc.

However if one mixes the coke dust as explained by this invention with a carbon containing substance, for instance, a fine coal, the undesirable properties of the coke dust do not appear anymore as such, and one obtains a mixture that handles normally and without difficulty. It is an essential part of the instant invention that the carbon containing substance used to produce the mixture must have a size composition similar to the size composition of fine coal. As a matter of fact only then can carbon containing substances bind the finely ground coke in such a way that the final product maintains its shape and no segregation occurs during the various handling and transportation operations, especially unloading and reloading. The volume weight of the mixture in accordance with this invention is about the same as that of the said carbon containing substance. It thus exceeds the arithmetical average of the volume weights of the carbon containing substance and the coke dust so that the above-mentioned advantages of the coke dust are not only preserved in the mixture but there also occurs an additional increase in density due to a filling effect of the finely ground coke dust in connection with the carbon containing substance.

In other words, by applying the instant invention to a coal destined for coking in a coke oven, which coal heretofore has used up in all respects full transport space, the inventive weight is reduced by preliminary coking and the transport volume required is reduced by fine grinding and mixing the finely ground coke with the carbon containing substance.

In addition, the coking component in accordance with the invention, including of the carbon containing substance and finely ground coke, can be transported without difficulty using the regular conveying equipment available in the respective plant. It can be stored in silos without difficulty and proportioning it for blending in view of preparing a coke oven charge does not present a problem.

Blending the coking component according to the invention with the other regular components to constitute the coke oven input blend is then done in the usual way.

DETAILED DESCRIPTION OF PREFERRED EMBODIMENTS

In the production of a coking component in accordance with the instant invention, the following points of view respectively should be taken into account:

The coking of the raw material used to produce the coke dust, which raw material can be a coking coal but also a non-coking coal, lignite, petroleum coke or high temperature coke, can be accomplished by any process suited for the respective raw material. Preferably a continuous process is applied which also permits the through-put of non-coking raw materials. Coking-/devolatilization should be as complete as possible, i.e., the resulting coke should have less than 2 % or, still better, less than 1 % volatiles.

If the coke produced is not dry, it should be dried before grinding. Ball mills are suitable for this grinding, and as in the case of coke dust used up to this date, the grinding is done in such a way that a cement-like degree of fineness is achieved, i.e., substantially a size of 90% below 0.5 mm, preferably 90% below 0.2 mm.

The carbon containing substance, for instance, coal, lignite, semi-coke or petroleum coke, functioning as a vehicle for the coke dust, serves this purpose best if it shows 90 % below 3 mm. In order to avoid segregation of the mixture, the carbon containing substance should have a moisture content of 5–10%. In the case of lower moisture the danger exists that the stability of the mixture becomes too weak; at higher humidity, just as in the case of direct water addition, there exists the danger of clot formation.

The proportion between coke dust and the carbon containing substance can vary within fairly wide limits, governed by the respective conditions, and can be optimized by means of practical tests. As already indicated, one of the aims of the invention is also to achieve as high a volume weight corresponding to a low stowage factor of the coking component as possible. At less than 10 % coke dust in the mixture, the advantages obtained by the invention will generally be too insignificant. More than 60 % of coke dust in the mixture would however favour segregation of the mixture. The moisture content of the carbon containing substance can also have some influence on the above limits, especially in combination with the size composition of the carbon containing substance.

Apart from this, the proportion of coke dust in the coking component, in accordance with the invention, can be governed by the specific requirements of the coking plant. In case the coke oven blend is supposed to contain a high percentage of the carbon containing substance used as a binder for the coke dust, the component in accordance with the invention should contain an accordingly small percentage of coke dust, being careful that the percentage of the coke dust does not fall below the above mentioned limit of 10–12 %. If only a small percentage of the carbon containing substance can be used in the coking blend, the relative proportion of coke dust to carbon containing substance in the component according to the invention will be as high as the preservation of the stability of the component permits, this in order to exploit to the highest possible degree the beneficial effect of the coke dust.

Likewise the type of carbon containing substance chosen to serve as vehicle to the coke dust is governed by the other coals used in the coke oven blend. As to the properties of the mixture from the transport point of view the qualitative analytical properties of the coking component according to the invention are of no importance.

EXAMPLE I

A preferred embodiment of the invention is to convert a high volatile coal which can be used in a coke oven blend into a coking component according to the invention, because in that case the removing of the volatiles is specifically advantageous in connection with transportation. The use of such high volatile coal as such must be limited because of its effect on the mechanical properties of the coke to be produced. Therefore the transformation of such coal into a coking component according to the invention, whereby such coal functions as raw material and as binder/vehicle for the coke dust, has the further advantage that the percentage of such coal which can be used in coking operations is increased.

Below is described an example for the production of such a coking component. 100 tons of high volatile non coking coal of Australian origin, analysis A (table 1) are coked in a continuous way in a rotary hearth furnace, resulting in 54 tons of coke with analysis B, (table 1).

This coke is ground in a ball mill to 90 % below 0.2 mm. It is then homogeneously mixed with 54 tons of high volatile soft coking fine coal of Australian origin having an analysis C (table 1).

The resulting coking component according to the invention has the analysis D (table 1).

The fixed carbon content in the coking component according to the invention goes up to 70 % from 48 % and 52% respectively in the two basis coals.

Table 1

| | A | B | C | D |
|---|---|---|---|---|
| Water | 10% | 0 | 10% | 5% |
| Ash | 7% | 11.6% | 7% | 9.3% |
| Volatiles | 40% | 0.5% | 35% | 18% |
| Swelling-Index | 1 | 0 | 4–5 | 3 |
| Density | 720kg/m³ | 620kg/m³ | 720kg/m³ | 720Kg/m³ |
| Fixed Carbon | 48% | 88% | 52% | 70% |
| Size | 0–20 mm | — | 90% below 3 mm | 95% below 3 mm |

EXAMPLE II

A further advantageous embodiment is the utilization of coals that have no swelling index, such as oxidized coal, for example. For practical purposes such coal becomes utilizable only after it has been converted into a coking component according to the invention. Also in this case the fine coal used as binder/vehicle for the coke dust can be the same coal, for instance, oxidized coal as the one used as a raw material for the coke dust. This of course is possibly only to the extent that the other components of the blend have enough swelling properties to tolerate a certain percentage of such coal. Below is described an example:

100 tons of oxidized coal of Canadian origin, analysis A (table 2) are coked in a continuous way in a rotary hearth furnace, resulting in 72 tons of coke with analysis B (table 2). This coke is ground in a ball-mill to 90 % below 0.2 mm. It is then homogeneously mixed with 72 tons of fine coking coal of Canadian origin, having an analysis C (table 2).

The resulting coking component according to the invention has the analysis D (table 2).

The fixed carbon content in the coking component according to the invention goes up to 75 % from 63.4 % in the two basis coals.

Table 2

| | A | B | C | D |
|---|---|---|---|---|
| Water | 10% | 0 | 10% | 5% |
| Ash | 10% | 12% | 10% | 11% |
| Volatiles | 20% | 0.5% | 20% | 10.2% |
| Swelling Index | 1 | 0 | 7 | 3–4 |
| Density | 720kg/m³ | 620kg/m³ | 720kg/m³ | 720kg/m³ |
| Fixed Carbon | 63,4% | 87,6% | 63,4% | 75% |
| Size | 0–10 mm | — | 90% below 3 mm | 95% below 3 mm |

EXAMPLE III

Finally an advantageous embodiment consists in completely devolatilizing crude petroleum coke, then finely grinding it and mixing it with a coking or a non-coking fine coal or with raw petroleum coke of corresponding size composition. Since petroleum coke has practically no ash, the ratio of fixed carbon to other analytical figures is particularly advantageous. If one also uses raw petroleum coke as binder/vehicle for the dust, one achieves the technically best possible concentration of fixed carbon for transportation. The use in a coke oven blend of coke dust produced from petroleum coke is also novel per se. Furthermore because of the significantly low ash content and the high proportion of fixed carbon in relation with volume, it is particularly advantageous. Below is described an example:

100 tons of petroleum coke of U.S. origin, analysis A (table 3) are coked in a continuous way in a rotary hearth furnace, resulting in 81 tons of coke with analysis B (table 3). This coke is ground in a ball-mill to 90 % below 0.2 mm. It is then homogeneously mixed with 81 tons of petroleum coke of U.S. origin having an analysis C (table 3).

The resulting coking component according to the invention has the analysis D (table 3).

The fixed carbon in the coking component according to the invention goes up to 90% from 81 % in the original raw petroleum coke.

Table 3

| | A | B | C | D |
|---|---|---|---|---|
| Water | 10% | 0 | 10% | 5% |
| Ash | <0.5% | <0.5% | <0.5% | <0.5% |
| Volatiles | 10% | 0.5% | 10% | 5% |
| Swelling-Index | 1 | 0 | 1 | 0 |
| Density | 720kg/m³ | 620kg/m³ | 720kg/m³ | 720kg/m³ |
| Fixed Carbon | 81% | 99% | 81% | 90% |
| Size | 0–30 mm | — | 0–10 mm | 0–10 mm |

What we claim is:

1. A coking component of a coking mixture which is easier to transport than coke dust and which has an increased fixed carbon content, said coking component consisting of a mixture of 10–60% of finely ground coke and at least one carbon-containing substance selected from the group consisting of coking coal, non-coking coal, petroleum coke, semi-coke or lignite; said carbon-containing substance having a particle size of 90% below 3 mm; said coking component adapted to be mixed with coal to form the coking mixture and coked.

2. The coking component according to claim 1 in which the finely ground coke has less than 2% volatile content.

3. The coking component according to claim 2 in which the finely ground coke has less than 1% volatile content.

4. The coking component according to claim 1 in which the finely ground coke has a size of 90% below 0.5 mm.

5. The coking component according to claim 4 in which the finely ground coke has a size of 90 % below 0.2 mm.

6. The coking component according to claim 1 in which the finely ground coke is high temperature coke.

7. The coking component according to claim 1 in which the percentage of finely ground coke represents 30–60 % of the mixture.

8. The coking component according to claim 1 in which the finely ground coke is made of at least one coal of the group consisting of coking coal, non coking coal and petroleum coke.

9. The coking component according to claim 1 in which said carbon containing substance is produced from the same raw material basis as the finely ground coke.

10. The coking component as claimed in claim 1, said carbon-containing substance being a high volatile soft coking fine coal, and said component having the following analysis, with percentages taken as percent by weight:

| | |
|---|---|
| Water | 5% |
| Ash | 9.3% |
| Volatiles | 18% |
| Density | 720 kg/m³ |
| Fixed Carbon | 70% |
| Particle Size | 95% below 3 mm. |

11. The coking component as claimed in claim 1, said carbon-containing substance being fine coking coal, and said component having the following analysis, with percentages taken as percent by weight:

| | |
|---|---|
| Water | 5% |
| Ash | 11% |
| Volatiles | 10.2% |
| Density | 720 kg/m³ |
| Fixed Carbon | 75% |
| Particle Size | 95% below 3 mm. |

12. The coking component as claimed in claim 1, said carbon-containing substance being petroleum coke, and said component having the following analysis, with percentages taken as percent by weight:

| | |
|---|---|
| Water | 5% |
| Ash | less than 0.5% |
| Volatiles | 5% |
| Density | 720 kg/m³ |
| Fixed Carbon | 90% |
| Particle Size | up to 10 mm. |

* * * * *